US006807905B2

(12) United States Patent
Deslangle et al.

(10) Patent No.: US 6,807,905 B2
(45) Date of Patent: Oct. 26, 2004

(54) FOUNTAIN OR DAMPENING DUCT FOR A DAMPENING UNIT OF AN OFFSET PRINTING MACHINE

(75) Inventors: Dominique Deslangle, Orleans (FR); Jacques Metrope, Laigneville (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/163,006

(22) Filed: Jun. 5, 2002

(65) Prior Publication Data

US 2003/0000399 A1 Jan. 2, 2003

(30) Foreign Application Priority Data

Jun. 5, 2001 (DE) ..... 101 27 251

(51) Int. Cl.[7] ..... B41F 31/06
(52) U.S. Cl. ..... 101/148; 101/147
(58) Field of Search ..... 101/364, 367, 101/148, 147, 347

(56) References Cited

U.S. PATENT DOCUMENTS 2,201,452 A * 5/1940 Pollock ..... 101/157
4,574,695 A * 3/1986 Ryan ..... 101/148
4,682,542 A 7/1987 Wieland
5,870,952 A 2/1999 Eichner et al.

FOREIGN PATENT DOCUMENTS

DE 35 19 294 A1 12/1986
DE 295 03 535.8 U1 7/1995
EP 0 947 319 A1 10/1999

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Ralph E. Locher

(57) ABSTRACT

A fountain for a dampening unit of an offset printing machine includes a container having an inlet for dampening solution and a return for the dampening solution. The container is formed with a base, at least one side wall connected to the base and a dam disposed on the base. The dam is formed with an upper edge that is lower than an upper edge formed on the one side wall. A dividing wall has a run-off edge and an infeed edge. The dividing wall is seated on the upper edge of the dam and, starting from the dam, extends over the base to as far as the infeed edge. The infeed edge defines the level of the dampening solution in the fountain.

9 Claims, 3 Drawing Sheets

FOUNTAIN OR DAMPENING DUCT FOR A DAMPENING UNIT OF AN OFFSET PRINTING MACHINE

BACKGROUND OF THE INVENTION

Field of the Invention

The invention relates to a fountain or dampening duct for a dampening unit of an offset printing machine, the fountain having an inlet for dampening solution or medium, a return for the dampening solution, a base, at least one side wall, and a dam formed with an upper edge that is lower than an upper edge formed on the side wall.

A fountain of the foregoing general type is disclosed by Published European Patent Application EP 0 947 319 A1. The fountain described therein has an inlet for a dampening solution or medium, a return for the dampening solution, a base, side walls and a dam, an upper edge of which is lower than an upper edge of the side wall. This fountain is part of a dampening unit which is generally used in offset printing machines, in particular rotary offset printing machines, for applying the dampening solution to a printing form before ink is fed to the printing form. For this purpose, the dampening unit is also provided with a dampening roller, which is arranged at least approximately horizontally above the fountain and dips with a lower part of the circumferential surface thereof into dampening solution provided in the fountain and, as the dampening roller rotates, it transfers the dampening solution into the dampening unit and ultimately to the printing form. The dampening solution adheres to the hydrophilic areas of the printing form, which are defined by the image to be printed that is on the printing form. Moreover, the hydrophobic ink is applied to the printing form and adheres to the hydrophobic areas of the printing form, which are not covered by the dampening solution. In this manner, an inked image is produced on the printing form and, if necessary or desirable, after transfer from the printing form to a rubber blanket cylinder, is transferred to a printing material, for example, a paper web, cardboard or pasteboard, polymer material or the like.

In the case of the heretofore known dampening-solution fountain, the dam extends parallel to the longitudinal axis of the dampening roller. The inlet is provided at the bottom, close to the side wall opposite the dam. Because the upper edge of the dam is lower than the upper edge of the side walls, the dampening-solution level in the fountain is defined thereby. The dampening solution is directed continuously through the inlet into the fountain with the aid of a circulating pump, and the dampening solution running over the upper edge of the dam flows into a collecting channel provided with the return, and is guided back through the return to the circulating pump.

A dampening-solution fountain of the type mentioned at the introduction hereto is also disclosed by the Published German Utility Model DE 295 03 535 U1, corresponding to U.S. Pat. No. 5,870,952. In this fountain, the inlet is formed by a tube which, at the bottom, close to the side wall opposite the dam, extends over the entire length of the side wall and is formed with numerous small openings which are distributed over the entire length thereof.

In both of the foregoing heretoforeknown dampening-solution fountains, the flow of the dampening solution into the fountain is not uniform, i.e., neither in the case of the inlet being at a single point according to the Published European Patent Application EP 0 947 319 A1 nor in the case of the inlet being at numerous locations according to the Published German Utility Model DE 295 03 535 U1, corresponding to U.S. Pat. No. 5,870,952. As a result, a constant temperature distribution over the entire length of the fountain cannot be ensured. In addition, the heretoforeknown fountains have a rectangular outline, so that stagnation points necessarily occur. At these stagnation points, contaminants accumulate which originate from the environment of the printing machine and, for example, comprise small balls of ink which are produced in the inking unit. This accumulation of contaminants in the fountain rapidly becomes significant, and contaminates all of the dampening solution in the fountain. As a result, depending upon the composition of the dampening solution, the chemical stability of the dampening solution can be destroyed. Because a constant quality of the dampening and, accordingly, of the dampening solution is indispensable for optimum printing quality, it is necessary to empty and clean the dampening-solution fountain often in order to maintain the printing quality.

SUMMARY OF THE INVENTION

It is accordingly an object of the invention to provide a fountain for a dampening unit of a printing machine, which permits a longer service interval, i.e., in particular, requires less frequent emptying and cleaning, than heretofore known fountains of this general type.

With the foregoing and other objects in view, there is provided, in accordance with the invention, a fountain for a dampening unit of an offset printing machine, comprising a container having an inlet for dampening solution and a return for the dampening solution, the container being formed with a base, at least one side wall connected to the base and a dam disposed on the base, the dam being formed with an upper edge that is lower than an upper edge formed on the one side wall, and further comprising a dividing wall having a run-off edge and an infeed edge, the dividing wall being seated on the upper edge of the dam and, starting from the dam, extending over the base to as far as the infeed edge, the infeed edge serving to define the level of the dampening solution in the fountain.

In accordance with another feature of the invention, the dividing wall has an upper side curved concavely with respect to the longitudinal axis of the fountain.

In accordance with a further feature of the invention, the radius of curvature of the concavely curved upper side of the dividing wall is constant, at least in sections.

In accordance with an added feature of the invention, the radius of curvature is greater than the radius of a dampening roller of the dampening unit.

In accordance with an additional feature of the invention, the infeed edge and the run-off edge of the dividing wall are at the same height.

In accordance with yet another feature of the invention, the infeed edge is higher than the run-off edge.

In accordance with yet a further feature of the invention, the dividing wall has an upper side that is flat, at least in sections, and is inclined at least approximately parallel to the longitudinal axis of the fountain so that the infeed edge is higher than the run-off edge.

In accordance with yet an added feature of the invention, the inlet is provided on the base adjacent to the dam.

In accordance with a concomitant feature of the invention, the fountain further comprises a collecting channel running beneath the run-off edge of the dividing wall and provided with the return.

Thus, the dampening-solution fountain according to the invention is provided with a dividing wall or partition having a run-off edge and an infeed edge, the dividing wall being seated on the upper edge of the dam and, starting from the latter, extending over the base to as far as the infeed edge, the infeed edge serving to define the level of the dampening solution.

Because the dividing wall is seated on the dam, the dampening solution can no longer run over the upper edge thereof, as in heretofore known fountains, but over the infeed edge of the dividing wall. From there, it is distributed on the upper side of the dividing wall, and flows at the run-off edge to the return. It is thus possible to produce a flow of the dampening solution at least approximately parallel to the circumferential surface of the dampening roller, at least in some sections. In this regard, the dampening roller is arranged above the dividing wall in a manner that a lower part of the circumferential surface thereof is wetted by the dampening solution at the upper side of the dividing wall.

In addition, the dividing wall serves as a cover, because contaminants falling down onto the fountain tend to land on the upper side thereof and are continuously flushed away by the dampening solution flowing on the upper side thereof towards the discharge edge. It is therefore no longer possible for downwardly dropping contaminants to accumulate in the dampening-solution fountain. Provision can be made for the upper side of the dividing wall to be curved concavely with respect to the longitudinal axis of the fountain, at least in some sections. The dividing wall therefore forms a channel extending at least approximately parallel to and under the dampening roller of the dampening unit.

In this case, provision can be made for the radius of curvature to be greater than the radius of the dampening roller. Provision can then preferably be made for the circumferential surface of the dampening roller of the dampening unit and the dividing wall to form concentric circular sections, at least in some sections.

In this case, provision can additionally be made, in a first alternative, for the infeed edge and the run-off edge to be at least at approximately the same height. Although the infeed edge and the run-off edge are at least at approximately the same height, the dampening solution nevertheless flows away over the run-off edge, because dampening solution is introduced continuously through the inlet into the fountain and flows over the infeed edge onto the upper side of the dividing wall. The desired flow of the dampening solution from the infeed edge towards the run-off edge can be assisted, in this first alternative, by having the dampening roller rotating in a manner that the lower part of the circumferential surface thereof moves from the infeed edge towards the run-off edge.

In this case, provision can additionally be made, in a second alternative, for the infeed edge to be higher than the run-off edge. Here, the desired flow of the dampening solution from the infeed edge towards the run-off edge is already achieved by the difference in height between these two edges. The dampening roller can then also rotate without difficulty in such a manner that the lower part of the circumferential surface thereof moves from the run-off edge towards the infeed edge.

The fountain according to the invention permits the time interval between maintenance operations to be longer than for conventional fountains, because, due to an encapsulation of part of the dampening solution in the fountain according to the invention, the latter is protected against contaminants and, due to the flow of dampening solution at least approximately parallel to the circumferential surface of the dampening roller, contaminants can be transported away over the run-off edge. Emptying and cleaning is therefore less frequently required.

Furthermore, in the dampening-solution fountain according to the invention, provision can be made for the upper side of the dividing wall to be flat, at least in some sections, and to be inclined at least approximately parallel to the longitudinal axis of the fountain in a manner that the infeed edge is higher than the run-off edge.

Furthermore, provision can be made for the inlet to be provided at the bottom of the fountain adjacent to the dam. Because the inlet is located far removed from the infeed edge, any flows which arise in the vicinity of the inlet as a result of the introduction of the dampening solution do not disrupt the flow of the dampening solution rising towards the infeed edge, so that the dampening solution can flow quietly and uniformly over the infeed edge. Provision can additionally be made for a collecting channel to run underneath the run-off edge of the dividing wall, and for the collecting channel to be provided with the return.

Other features which are considered as characteristic for the invention are set forth in the appended claims.

Although the invention is illustrated and described herein as embodied in a fountain for a dampening unit of an offset printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
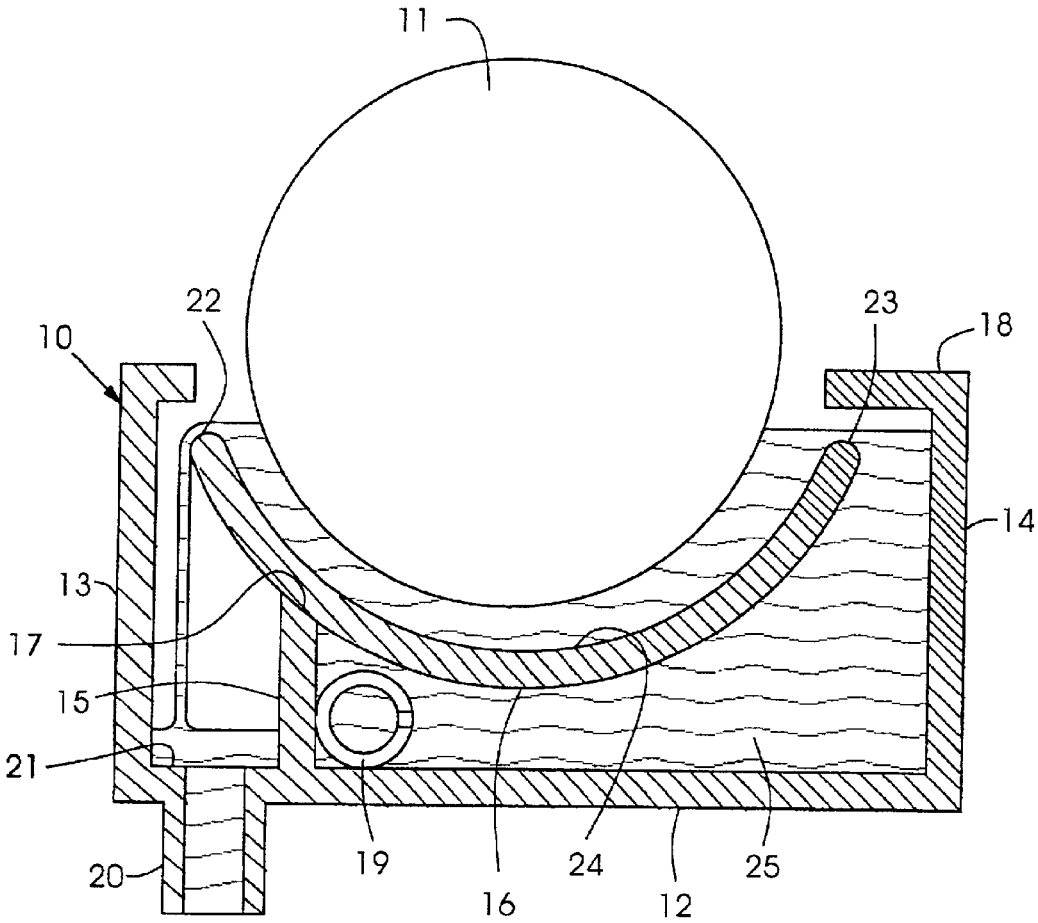
FIG. 1 is a diagrammatic cross-sectional view of a dampening unit having a first embodiment of a fountain constructed in accordance with the invention.

Referring now to the drawings and, first, particularly to FIG. 1 thereof, there is illustrated therein a dampening unit for an offset printing machine, having a first embodiment of a fountain 10 and a dampening roller 11. The fountain 10 has an at least approximately rectangular base 12, four side walls, of which only the left-hand side wall 13 and the right-hand side wall 14 are shown in FIG. 1, a dam 15 and a dividing wall or partition 16.

The base is at least approximately rectangular, and the length and width thereof are selected so that the dampening roller 11 can project with at least part of the lower circumferential surface thereof into the interior of the fountain 10.

The side walls 13 and 14 are of like height, as well as higher than the dam 15, so that an upper edge 17 of the dam 15 is lower than the upper edge 18 of the side walls 13 and 14. The fountain 10 additionally has an inlet 19 for the dampening solution, and a return 20 for the dampening solution, which are connected to an otherwise non-illustrated circulatory system. The inlet 19 is introduced at the right-hand side of the dam 15 through the base 12 into the fountain 10. The return 20, near the left-hand side of the dam 15 extends through the base 12, into a collecting channel 21, which is formed by the left-hand side wall 13 and the dam 15.

The dividing wall 16 has a run-off edge 22 which lies above the collecting channel 21, and an infeed edge 23 which lies a slight distance to the left-hand side of the right-hand side wall 14. The dividing wall 16 is seated like a cover on the upper edge 17 of the dam 15 and secured thereon, for example, by suitable welding or adhesive, starting from this upper edge 17, extends over the base 12 to as far as the infeed edge 23 of the dividing wall 16. The infeed edge 23 is disposed lower than the upper edge 18 of the right-hand side wall 14 and, therefore, defines the dampening-solution level in the fountain 10.

In this first embodiment, the upper side 24 of the dividing wall 16 is curved concavely with respect to axes of the fountain 10 and of the dampening roller 11, which extend in a common longitudinal direction, and the infeed edge 23 and the run-off edge 22 are of like height. In addition, the radius of curvature of the upper side 24 is constant and greater than the radius of the dampening roller 11, and the upper side 24 runs concentrically to the circumferential surface of the dampening roller 11. The aforementioned radii are selected so that the dampening roller 11 is located with part of the lower circumferential surface thereof lower than the infeed edge 23.

During operation, the dampening solution is directed through the inlet 19 into the chamber 25 which is formed between the dividing wall 16 and the base 12. The dampening-solution level in this chamber 25 rises until the dampening solution has reached the infeed edge 23. If dampening solution then continues to be introduced into the chamber 25, it flows over the infeed edge 23 out of the chamber 25 and onto the upper side 24 of the dividing wall 16. Because the dividing wall 16 forms a channel open at the top, the dampening-solution level in the channel formed by the dividing wall 16 rises until it has reached the run-off edge 22. If dampening solution then continues to be introduced, the dampening solution flows over the run-off edge 22, out of the channel formed by the dividing wall 16 and into the collecting channel 21 and, from there, out of the fountain 10 through the return 20. As long as dampening solution then continues to be introduced into the chamber 25 through the inlet 19, the dampening solution flows from the infeed edge 23 through the gap formed between the lower part of the circumferential surface of the dampening roller 11 and the upper side 24, towards the run-off edge 22, so that any contaminants which have fallen onto the dividing wall 16 or which have fallen onto the dampening roller 11 and, because of the rotation of the latter, have been introduced by the latter into the dampening solution on the dividing wall 16, are flushed into the collecting channel 21.

Figure 2:
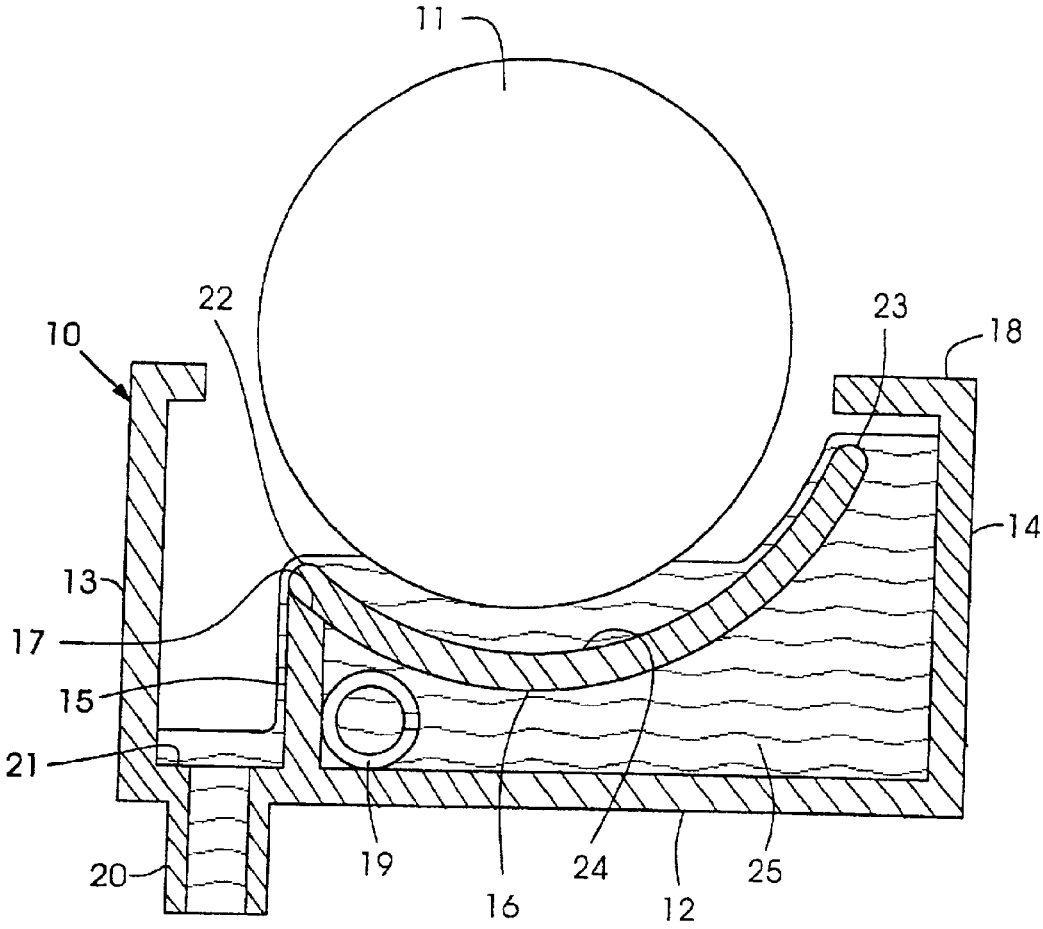
FIG. 2 is a view like that of FIG. 1 of a dampening unit having a second embodiment of the fountain.

In FIG. 2, the dampening unit of FIG. 1 is illustrated with a second embodiment of the dampening-solution fountain 10. This second embodiment differs from the first embodiment in that the run-off edge 22 is lower than the infeed edge 23. As a it result, the dampening-solution level in the channel-like dividing wall 16 is lower than in the first embodiment, more specifically, is at the height of the run-off edge 22.

Figure 3:
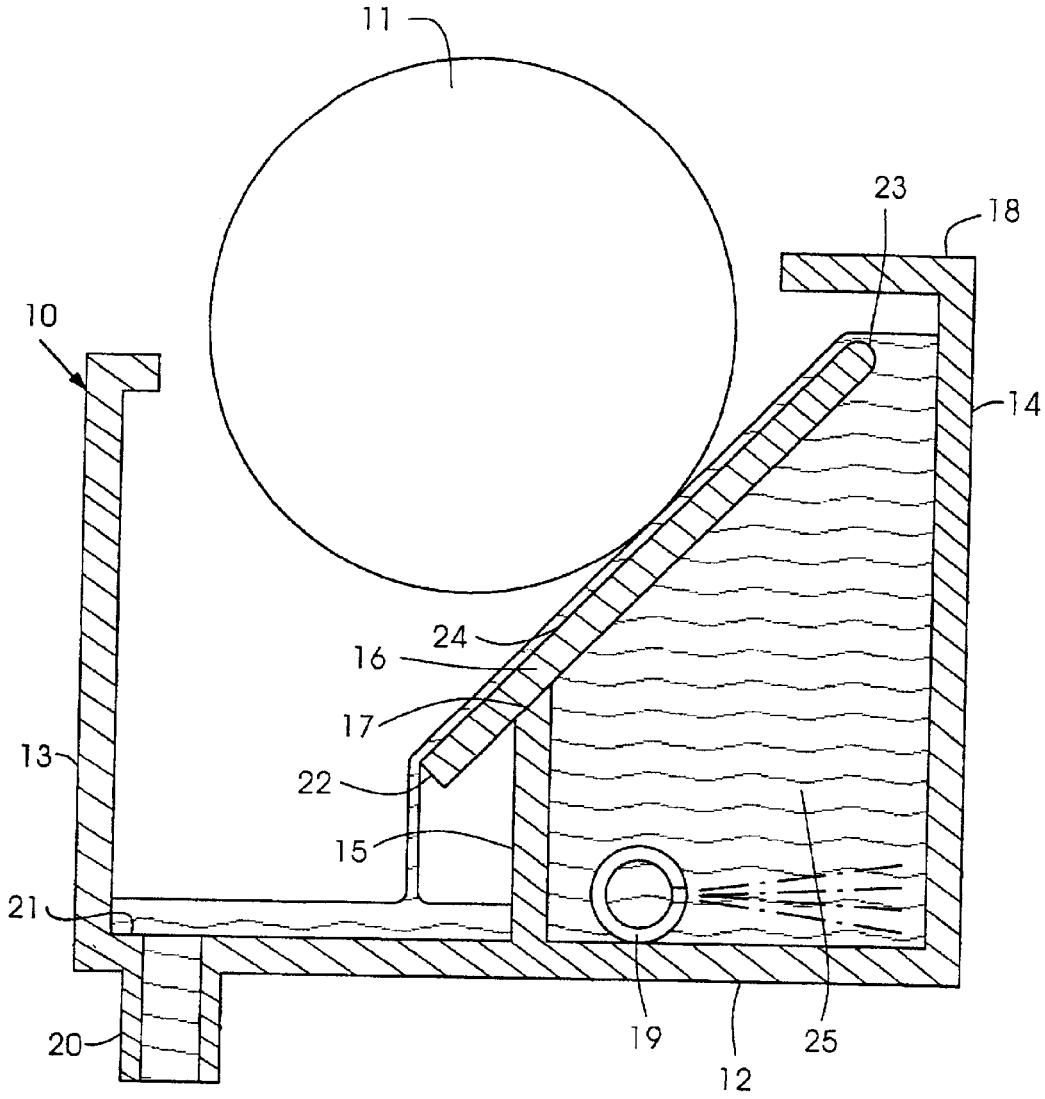
FIG. 3 is a view like those of FIGS. 1 and 2 of a dampening unit having a third embodiment of the fountain.

In FIG. 3, the dampening unit of FIGS. 1 and 2 is illustrated with a third embodiment of the fountain 10. This third embodiment differs from the second embodiment in that the upper side 24 of the dividing wall 16 is flat. In addition, it is inclined parallel to the longitudinal axis of the fountain in a manner that, as in the second embodiment, the infeed edge 23 is higher than the run-off edge 22. Because, in this third embodiment, the dampening solution cannot accumulate on the upper side 24, but runs from the infeed edge 23 in a thin film over the upper side 24 towards the run-off edge 22, the distance here between the circumferential surface of the dampening roller 11 and the upper side 24 has to be kept considerably smaller than in the case of the first and the second embodiments, so that the lower part of the circumferential surface is wetted by the dampening solution film over the entire length of the dampening roller 11.

We claim:

1. A fountain for a dampening unit of an offset printing machine, comprising a container having an inlet for dampening solution and a return for the dampening solution, said container being formed with a base, at least one side wall connected to said base and a dam disposed on said base, said dam being formed with an upper edge being lower than an upper edge formed on said one side wall, a dividing wall having a run-off edge and an infeed edge, said dividing wall being seated on said upper edge of said dam and, starting from said dam, extending over said base to as far as said infeed edge, said infeed edge defining a level of the dampening solution in the fountain during normal operation.

2. The fountain according to claim 1, wherein said dividing wall has an upper side curved concavely with respect to the longitudinal axis of the fountain.

3. The fountain according to claim 2, wherein a radius of curvature of said concavely curved upper side of said dividing wall is constant, at least in sections.

4. The fountain according to claim 3, wherein the radius of curvature is greater than a radius of a dampening roller of the dampening unit.

5. The fountain according to claim 1, wherein said infeed edge and said run-off edge of said dividing wall are at the same height.

6. The fountain according to claim 1, wherein said infeed edge is higher than said run-off edge.

7. The fountain according to claim 1, wherein said dividing wall has an upper side being flat, at least in sections, and is inclined at least approximately parallel to the longitudinal axis of the fountain so that said infeed edge is higher than said run-off edge.

8. The fountain according to claim 1, wherein said inlet is provided on said base adjacent said dam.

9. The fountain according to claim 1, further comprising a collecting channel running beneath said run-off edge of said dividing wall and being provided with said return.

* * * * *